US005899754A

United States Patent [19]

Beloritsky et al.

[11] Patent Number: 5,899,754

[45] Date of Patent: May 4, 1999

[54] COAXIAL CONNECTOR

[75] Inventors: Victor Beloritsky, North Andover; Paul Joseph Lake, Waltham; Satishchandra Shantilal Mistry, Billerica, all of Mass.

[73] Assignee: The Whitaker Corporation, Wilmington, Del.

[21] Appl. No.: 09/023,507

[22] Filed: Feb. 13, 1998

[51] Int. Cl.[6] ..... H01R 9/09

[52] U.S. Cl. ..... 439/63; 439/158

[58] Field of Search ..... 439/63, 79, 581, 439/80

[56] References Cited

U.S. PATENT DOCUMENTS

| | | | |
|---|---|---|---|
| 4,634,198 | 1/1987 | Rush | 439/79 |
| 4,732,565 | 3/1988 | Ito et al. | 439/79 |
| 5,547,384 | 8/1996 | Benjamin | 439/79 |
| 5,645,454 | 7/1997 | Kosmala | 439/63 |
| 5,722,837 | 3/1998 | Kurahashi | 439/63 |

OTHER PUBLICATIONS

H.C. Schick, Crushed Tubing–Coaxial Connector, IBM Technical Disclosure Bulletin, vol. 7, No. 1, pp. 91–92, Jun. 1964.

*Primary Examiner*—Steven L. Stephan
*Assistant Examiner*—Hal Moon Hyeon
*Attorney, Agent, or Firm*—Gerald K. Kita; June B. Schuette

[57] ABSTRACT

A coaxial connector (1) has a resilient cantilever beam (23) extending from a central contact portion (6), a beam engaging surface (33) on insulation material (3) to limit movement by deflection of a first resiliently deflectable portion (24) of the beam (23), a tab electrical terminal (27) at an unsupported end of the beam (23), and the beam (23) being curved back on itself adjacent the tab electrical terminal (27) to provide a second resiliently deflectable portion (26) of the beam (23).

5 Claims, 2 Drawing Sheets

COAXIAL CONNECTOR

FIELD OF THE INVENTION

The invention relates to a surface mount coaxial connector, and more particularly, to a surface mount coaxial connector having a central electrical contact with a spring loaded electrical terminal establishing a pressure electrical connection.

BACKGROUND OF THE INVENTION

A known surface mount, coaxial connector has a central electrical contact with a tab terminal establishing an electrical connection when the solder tab terminal is joined by a solder joint to an electrically conducting pad on a circuit board. Avoiding a solder joint, is desirable, to reduce the cost and the exertion of painstaking care necessary to provide a quality solder joint.

It is desired to provide a coaxial connector that has a central electrical contact with a tab electrical terminal that establishes a surface mount electrical connection without a need for solder. It is known to provide an electrical terminal in the form of a stamped and formed, resilient spring that undergoes resilient deflection to provide sufficient contact pressure of the terminal against a conducting pad on a circuit board. The contact pressure can be elevated to a desired magnitude by increasing the dimensions of the stamped and formed spring. For a coaxial connector, a longer spring length would cause the connector to deviate from its desired characteristic impedance and insertion loss characteristics. For a coaxial connector, its outer diameter dimension is fixed to a standard size to assure intermating compatibility, which means a thicker contact spring for the same outer diameter dimension would cause the connector to deviate from its desired characteristic impedance.

SUMMARY OF THE INVENTION

According to the invention, a resilient cantilever beam has two resiliently deflectable portions that store spring energy that applies contact pressure to a tab electrical terminal at an unsupported end of the beam.

An embodiment of the invention will now be described by way of example with reference to the drawings, according to which:

DETAILED DESCRIPTION

Figure 1:
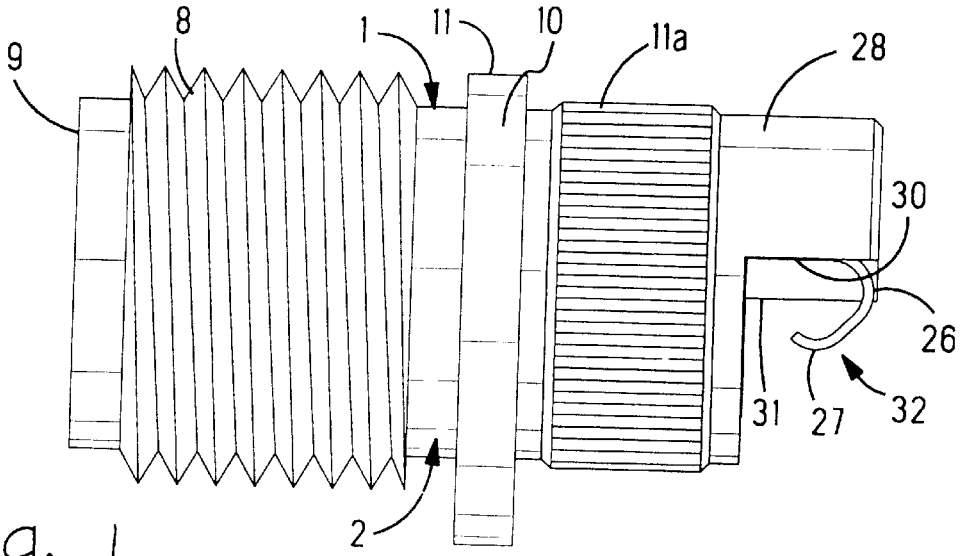
FIG. 1 is an enlarged side view of a coaxial connector.
Figure 2:
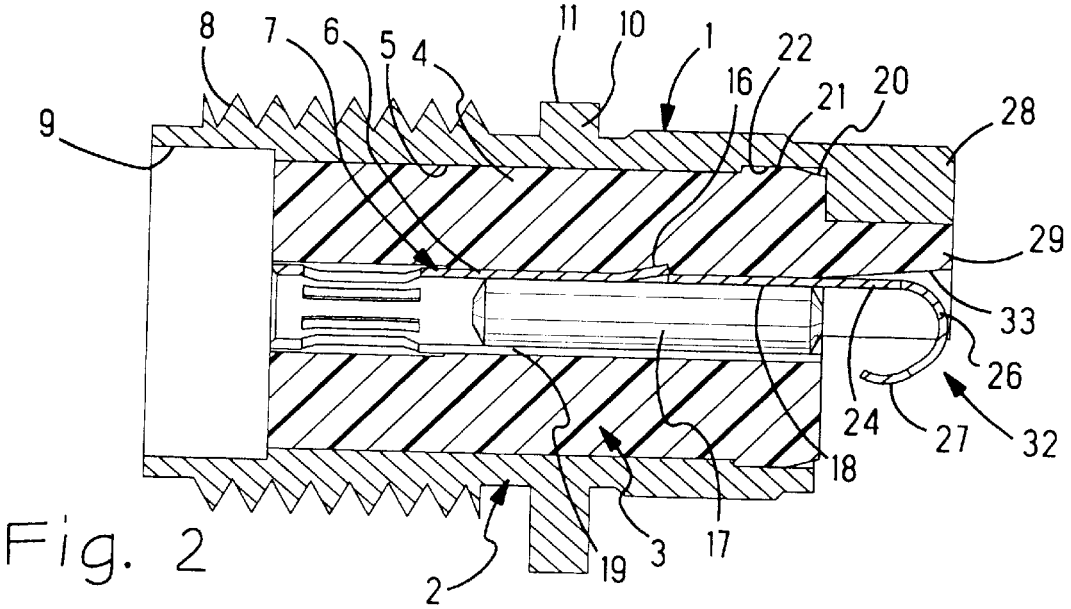
FIG. 2 is a section view taken along line 2—2 of FIG. 3, illustrating a conducting shell, insulation material and an electrical contact.
Figure 3:
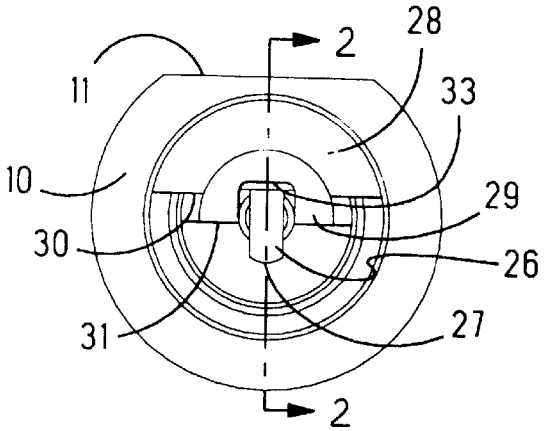
FIG. 3 is an end view of the connector as shown in FIG. 1.

With reference to FIG. 2, a coaxial connector 1 comprises, a conducting shell 2, insulation material 3 having a first portion 4 concentrically between a cylindrical portion 5 of the shell 2 and a central contact portion 6 of a stamped and formed electrical contact 7. With reference to FIG. 1, the shell 2 has external threads 8 at a mating end 9. With reference to FIG. 3, an exterior, circumferential flange 10 on the shell 2 has a flat surface 11 providing a reference surface for rotational orientation. Exterior knurling 11*a* on the shell adjacent the flange 10 establishes a friction fit of the shell in an opening through a panel, not shown.

Figure 4:
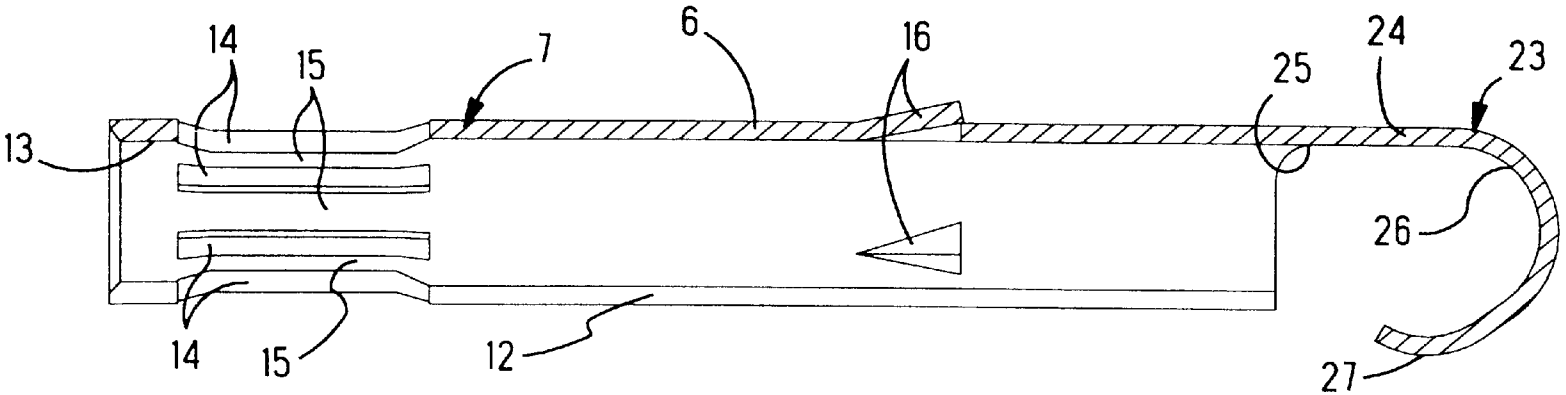
FIG. 4 is an enlarged view of the contact as shown in FIG. 2.
Figure 5:
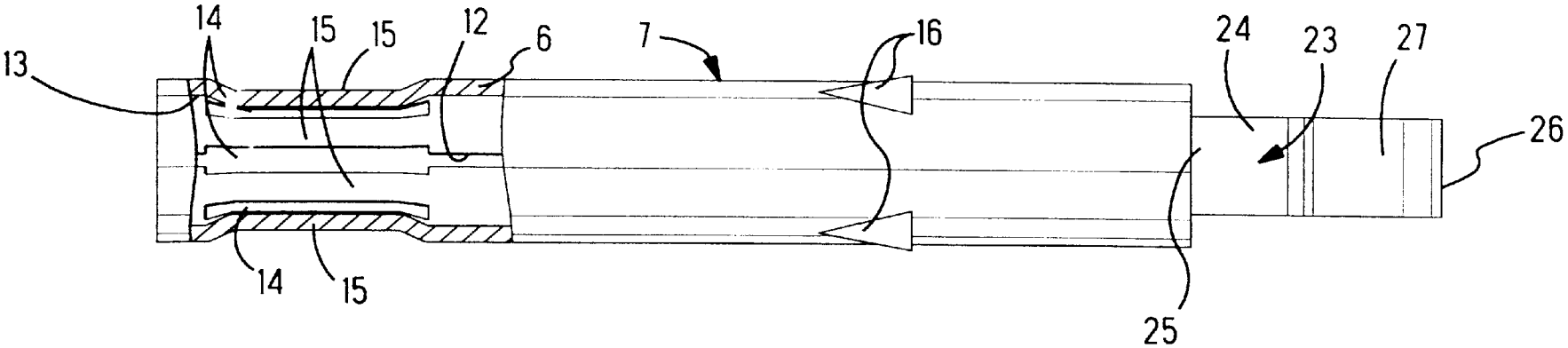
FIG. 5 is an enlarged bottom view of an electrical contact as shown in FIG. 4, with parts broken away.

With reference to FIGS. 4 and 5, the electrical contact 7 is of unitary construction that is stamped and formed from a flat sheet metal development of a cylinder. The sheet metal development is formed into a hollow cylindrical shape forming the central contact portion 6 that has a lengthwise open seam 12. At an open mating end 13 of the central contact portion 6, a series of axial slits 14 provide lengthwise, resilient beams 15 supported at their ends, which avoids their being broken away. The beams 15 are biased out of a thickness plane of the sheet metal, and are distributed circumferentially around a reduced diameter, electrical receptacle portion at the open mating end 13 of the central contact portion 6. Multiple barbs 16 are cut and bent to extend diagonally out of the thickness plane of the sheet metal, and outward of the central contact portion 6.

With reference to FIG. 2, an insulating plug 17 having end to end symmetry registers in an open rear end 18 of the central contact portion 6 to resist radial collapse of the central contact portion 6. The central contact portion 6 is assembled along a concentric, contact receiving cavity 19 extending through the first portion 4 of the insulation material 3. The barbs 16 impale upon the insulation material 3 and resist withdrawal of the electrical contact 7 from the insulation material 3. The beams 15 defining the electrical receptacle are forward of the plug 17.

With further reference to FIG. 2, the insulation material 3 is inserted along an internal diameter of the shell 2 from the open mating end 9. The insulation material 3 has a slight chamfer 20 to funnel its insertion along the internal diameter of the shell 2. The insulation material 3 has an enlarged stepped diameter portion 21 that is radially compressed during insertion, until expanding to seat in an enlarged stepped diameter cavity 22 in the interior of the shell 2 to resist further movement of the insulation material 3.

With reference to FIG. 4, the contact 7 has a unitary, resilient cantilever beam 23 projecting from the central contact portion 6. The beam 23 has a straight, first resiliently deflectable portion 24 projecting from a supported end 25 of the beam 23. The beam 23 has a second, resiliently deflectable portion 26 curved back on itself. With reference to FIG. 5, a tab electrical terminal 27 is at an unsupported end of the beam 23. The beam 23 is curved back on itself adjacent to the tab electrical terminal 27.

With further reference to FIG. 2, a portion 28 of the shell 2 overlaps a second portion 29 of the insulation material 3. A portion of the shell 2 and a portion of the insulation material 3 have respective, undercut recesses 30, 31, FIG. 3, providing a clearance space 32 in an underside of the connector 1 for the tab electrical terminal 27 to extend into the clearance space 32. It is desired for the tab electrical terminal 27 to establish a pressure electrical connection by surface engagement with a known conducting contact pad on a circuit board, not shown, which registers in the clearance space 32.

Features establishing the desired contact pressure will now be described. With reference to FIG. 2, the second portion 29 of the insulation material 3 has a beam engaging surface 33 extending angularly divergent relative to the first resiliently deflectable portion 24 to limit movement by deflection of the first resiliently deflectable portion 24. Movement of the first resiliently deflectable portion 24 is limited by engagement thereof against the surface 33 to avoid deflection to an extent that will exceed the yield point of the constituent material of the beam 23. Deflection of the first resiliently deflectable portion 24 stores resilient spring energy to apply a first component of force on the tab electrical terminal 27. Deflection of the curved back, second resiliently deflectable portion 26 of the beam 23 stores additional resilient spring energy to apply a second component of force on the tab electrical terminal 27, which provides a sum of the first and second components of force to establish a pressure electrical connection.

Although a preferred embodiment of the invention has been described, other embodiments and modifications are intended to be covered by the spirit and scope of the appended claims.

What is claimed is:

1. A coaxial connector comprising:

a conducting shell, insulation material having a first portion concentrically between a portion of the shell and a central contact portion of a stamped and formed electrical contact, a resilient cantilever beam extending from the central contact portion, a beam engaging surface on the insulation material extending angularly divergent relative to the beam to limit deflection of a first resiliently deflectable portion of the beam, a tab electrical terminal at an unsupported end of the beam, and the beam being curved back on itself adjacent the tab to provide a second resiliently deflectable portion of the beam.

2. A coaxial connector as recited in claim 1 wherein, a portion of the shell overlaps a portion of the insulation material having the beam engaging surface.

3. A coaxial connector as recited in claim 1 wherein, a portion of the shell and a portion of the insulation material have undercut recesses providing a clearance space for the tab electrical terminal extending into the clearance space.

4. A coaxial connector as recited in claim 1 wherein, deflection of the first beam portion is limited within a yield point of a constituent material of the beam.

5. A coaxial connector as recited in claim 1 and further comprising: an insulating plug in the central contact portion.

* * * * *